US010053656B2

(12) United States Patent
Budich

(10) Patent No.: US 10,053,656 B2
(45) Date of Patent: Aug. 21, 2018

(54) MULTIPHASE DETERGENT TABLET

(71) Applicant: BUDICH INTERNATIONAL GMBH, Hiddenhausen (DE)

(72) Inventor: Meinrad Budich, Hüllhorst (DE)

(73) Assignee: BUDICH INTERNATIONAL GMBH, Hiddenhausen (DE)

( * ) Notice: Subject to any disclaimer, the term of this patent is extended or adjusted under 35 U.S.C. 154(b) by 20 days.

(21) Appl. No.: 14/910,758

(22) PCT Filed: Jul. 31, 2014

(86) PCT No.: PCT/EP2014/066474
§ 371 (c)(1),
(2) Date: Feb. 8, 2016

(87) PCT Pub. No.: WO2015/022195
PCT Pub. Date: Feb. 19, 2015

(65) Prior Publication Data

US 2016/0194585 A1 Jul. 7, 2016

(30) Foreign Application Priority Data

Aug. 14, 2013 (DE) ..... 10 2013 108 814

(51) Int. Cl.
*C11D 17/00* (2006.01)
*C11D 3/08* (2006.01)
(Continued)

(52) U.S. Cl.
CPC ..... *C11D 17/0078* (2013.01); *C11D 3/044* (2013.01); *C11D 3/08* (2013.01);
(Continued)

(58) Field of Classification Search
CPC ..... C11D 3/044; C11D 3/08
See application file for complete search history.

(56) References Cited

U.S. PATENT DOCUMENTS 4,460,490 A * 7/1984 Barford ..... C11D 3/3953 252/186.25
5,133,892 A * 7/1992 Chun ..... C11D 3/38672 510/224
(Continued)

FOREIGN PATENT DOCUMENTS

DE 199 40 547 A1 3/2001
DE 103 55 858 A1 6/2005
(Continued)

OTHER PUBLICATIONS

International Search Report—PCT/EP2014/066474 dated Jan. 29, 2015.
(Continued)

*Primary Examiner* — Nicole M Buie-Hatcher
*Assistant Examiner* — M. Reza Asdjodi
(74) *Attorney, Agent, or Firm* — Studebaker & Brackett PC

(57) ABSTRACT

The invention discloses a multiphase detergent tablet (1), comprising a first detergent phase with at least one contact-unsuitable, in particular caustic, irritant, toxic or hygroscopic component and a second detergent phase to cover the first detergent phase, wherein the second detergent phase essentially contains no contact-unsuitable components, in particular no caustic, toxic or hygroscopic components, optionally also no irritant components and whereby the detergent tablet comprises at least three stacked layers, with a first layer (10) of the second detergent phase; a second middle layer (12) of the first detergent phase and a third layer (14) of the second detergent phase, wherein at least a part of a region of the contact-unsuitable first detergent phase that is not covered by a layer of the second detergent phase is provided with a water-soluble protective film. The invention further describes a method of manufacturing such a multi-
(Continued)

phase detergent tablet (1) and its use to clean kitchen appliances, particularly in commercial kitchens.

17 Claims, 2 Drawing Sheets

(51) Int. Cl.

| | |
|---|---|
| ***C11D 3/04*** | (2006.01) |
| ***C11D 3/10*** | (2006.01) |
| ***C11D 7/06*** | (2006.01) |
| ***C11D 7/12*** | (2006.01) |
| ***C11D 7/14*** | (2006.01) |

(52) U.S. Cl.
CPC ..... *C11D 3/10* (2013.01); *C11D 7/06* (2013.01); *C11D 7/12* (2013.01); *C11D 7/14* (2013.01); *C11D 17/0082* (2013.01)

(56) References Cited

U.S. PATENT DOCUMENTS 5,962,387 A * 10/1999 Gorlin ..... C11D 3/06 510/224
5,972,870 A 10/1999 Anderson
6,340,664 B1 1/2002 Gassenmeier et al.
6,551,981 B1 * 4/2003 Ricci ..... C11D 1/62 510/294
6,551,982 B1 * 4/2003 Ricci ..... C11D 3/38609 134/25.2
6,589,925 B1 7/2003 Binstock et al.
6,974,789 B1 * 12/2005 Whitaker ..... C11D 3/046 510/294
7,598,217 B2 10/2009 Burg et al.
2002/0032139 A1 * 3/2002 Nitsch ..... C11D 3/124 510/218
2002/0142931 A1 * 10/2002 DeNome ..... B65B 9/042 510/220
2002/0160930 A1 * 10/2002 Emmerson ..... C11D 3/225 510/445
2004/0067863 A1 * 4/2004 Speckmann ..... C11D 3/3925 510/312
2004/0127373 A1 * 7/2004 Burg ..... C11D 1/22 510/141
2005/0261156 A1 * 11/2005 Kottwitz ..... C11D 3/386 510/392
2013/0056896 A1 * 3/2013 Schmaelzle ..... C11D 3/221 264/115
2016/0194585 A1 * 7/2016 Budich ..... C11D 3/044 510/218

FOREIGN PATENT DOCUMENTS

DE 10 2011 106 092 A1 12/2012
DE 10 2013 100 195 A1 7/2014
EP 0 055 100 A1 6/1982
EP 0 976 820 A1 2/2000
EP 1 600 497 A1 11/2005
EP 1 808 482 A1 7/2007
WO 02/086047 A1 10/2002
WO 2007/068920 A1 6/2007
WO WO 2007080105 A1 * 7/2007 ..... C11D 17/0073

OTHER PUBLICATIONS

International Search Report—PCT/EP2014/066475 dated Jan. 29, 2015.
German Search Report—German Patent Application No. 10 2013 108 814.7 dated Mar. 27, 2014.

* cited by examiner

MULTIPHASE DETERGENT TABLET

The invention discloses a multiphase detergent tablet, a method of manufacturing a multi-phase detergent tablet, and use of such a multiphase detergent tablet to clean kitchen appliances, particularly in commercial kitchens.

Various types of detergent are available for cleaning heavily soiled surfaces and cooking appliances, based on different active ingredients. Often, these active ingredients are caustic, toxic, or irritate the skin so that such detergents should only be handled with appropriate safety precautions. For example, high-alkaline detergent tablets (for example as disclosed in German patent application 10 2013 100 195.5), usually intended for commercial applications, are labelled "caustic" and may only be handled with gloves according to the safety precautions.

Water-soluble protective film coatings, for example polyvinyl alcohol films, have a relatively short shelf-life on account of their high alkalinity and the films harden, become brittle and lose their water-soluble properties after only a short storage time, often after only a few weeks.

Since it cannot be ensured that all users always follow the safety precautions of the handling regulations, it is an object of the invention to provide a detergent tablet that allows reliable use and safe handling thereof. A further object of the invention is to provide a method of manufacturing such detergent tablets.

These and further objects are achieved by the multiphase detergent tablet of claim 1, the method according to claim 9 of manufacturing such a multiphase detergent tablet, and by the use according to claim 14 of such a multiphase detergent tablet.

According to the invention, such a multiphase detergent tablet comprises a first detergent phase with at least one contact-unsuitable, in particular caustic, irritant, toxic and/or hygroscopic component and a second detergent phase to cover the first detergent phase, whereby the second detergent phase essentially does not contain any contact-unsuitable components, in particular does not contain any caustic, toxic or hygroscopic components, and optionally does not contain any irritants.

In the context of the invention, contact-unsuitable components are elements that either should not come into contact with skin because they are either a health hazard or highly irritant, for example the toxic, caustic or irritant compounds mentioned above; or because they undergo chemical or physical change upon contact with skin, for example the hygroscopic bonds mentioned above. In other words, contact-unsuitable components are compounds that should be prevented as far as possible from coming into contact with the skin or surrounding areas.

The term toxic is to be understood to apply to substances or mixtures that are poisonous or harmful to humans upon contact with the skin or when inhaled or swallowed.

The term caustic is to be understood to apply to substances or mixtures that can cause chemical burns to humans, primarily burns of the skin or mucous membranes. Highly irritant is to be understood to apply to substances or mixtures that can cause severe eye injury. In both cases, this is given at pH values less than 2 or greater than 11.

The term irritant is to be understood to apply to substances or mixtures that irritate the eyes, the respiratory organs or the skin. This is the case at pH values less than 4 or greater than 10. Mildly irritant is to be understood to apply to compounds or materials that at most can lead to minor skin irritations, for example at a pH value of 8 to 10, or 4 to 5.

Hygroscopic compounds are compounds which, upon contact with water or moisture such as humidity, absorb the water to a large degree and may even incorporate it in their crystal lattice or form hydrates. Strongly hygroscopic compounds are compounds which can absorb at least one third of their own weight in water and/or are also used as a desiccant on account of their deliquescent properties, for example table salt (sodium chloride), calcium chloride, silica gel, sodium hydroxide, potassium hydroxide, methyl glycine diacetic acid, soda, phosphate, metasilicate and many acids also exhibit hygroscopic behavior.

In contrast, contact-suitable components are compounds and substances that cause little or no damage and that undergo little or no alteration upon contact with the skin or surrounding areas. Mildly irritant compounds that cause no lasting damage or only mild skin irritation can also be counted among them. The second detergent phase comprising "essentially" no contact-unsuitable components is to be understood to mean that the components in that detergent phase are preferably not present, or at least only in such quantities as to fulfill the above requirements relating to contact with the detergent phase.

In the context of the invention, a multiphase detergent tablet is a detergent tablet with three or more layers or levels arranged one above the other in order to obtain a detergent tablet with a layered construction of the first and second detergent phases and further optional detergent phases. Such horizontal layer structures are often referred to as sandwich structures. According to the invention, the detergent tablet comprises at least three stacked layers, with a first layer of the second detergent phase, a second middle layer of the first detergent phase, and a third layer of the second detergent phase. The first and third layers can have a similar or identical second detergent phase composition, or can comprise completely different components, as long as these fall under the definition of being essentially entirely or mostly contact-suitable or essentially do not contain any contact-unsuitable components. For example, a preferred embodiment of the invention comprises a three-layered detergent tablet with a first layer of the second detergent phase; a second middle layer of the first detergent phase and a third layer of the second detergent phase that has a different composition than the second detergent phase of the first layer. The compositions of the two outer layers can differ chemically as well as physically. Such a layered composition favorably allows the first detergent phase to be covered from two sides that are preferably chosen such that the two largest faces are covered by the second detergent phase. In this way, only the side faces of such a layered detergent tablet reveal an incompletely covered first detergent phase with contact-unsuitable components, i.e. specifically caustic, irritant or toxic components. This outwardly uncovered first detergent phase, for example on the sides of a detergent tablet, has a comparatively small surface area compared to the covered faces, but in order to reduce the contact area still further, in the detergent tablet according to the invention at least a part of a region of the contact-unsuitable first detergent phase, which is not covered by a layer of the second detergent phase, is provided with a water-soluble protective film, preferably a rapidly soluble protective film. In this way, safety in handling can be increased further, while at the same time ensuring that the middle layer dissolves quickly.

A colored design of the second detergent phase can visually indicate to the user the layers of the second detergent phase that contain no caustic or toxic, preferably also no irritant components. A different color, for example a warning color, can be used to identify the first detergent phase with which any contact should be avoided.

According to another aspect of the invention, a method of manufacturing such a multi-phase detergent tablet is provided, comprising the step of manufacturing a three-layered detergent tablet with a first detergent phase with at least one contact-unsuitable, in particular irritant, caustic, toxic or hygroscopic component; and a second detergent phase in the form of a cover of the first detergent phase on at least two opposing faces of the first detergent phase. According to the invention, at least a part of a region of the contact-unsuitable first detergent phase, not covered by a layer of the second detergent phase, is provided with a water-soluble protective film.

The step of covering advantageously provides a detergent tablet in which the two outer layers are made of the second detergent phase. These can be handled without any elaborate safety measures, for example without gloves, since they do not contain any caustic or toxic components, optionally also no irritant components. During the usual use of this detergent tablet, the user does not come into contact with the caustic, toxic or irritant components in the centrally arranged first detergent phase. The advantageous distribution of the various elements in the different compartments of an inventive multiphase detergent tablet allows a simple and economic provision of a detergent tablet that is safe to use. The relevant tableting procedures will be known to the skilled person.

The invention also describes the use of a multiphase detergent tablet to clean kitchen appliances, particularly in a commercial kitchen, such as industrial dishwashers, ovens, broilers, combi-steamers, food warmers, degreasers. The improved handling can achieve an increased safety of the user compared to the known detergent tablets that, for reasons of good solubility, often contain highly alkaline components, i.e. caustic and also irritant detergent components specifically also in their outer layers.

Further preferred embodiments and variations of the inventive detergent tablet and the inventive manufacturing method, as well as the use of such a detergent tablet are given in the dependent claims as well as the following description of preferred embodiments and the examples. The method of manufacture or the use can be realized according to the dependent claims relating to the inventive detergent tablet.

In a further preferred embodiment of the invention, the detergent tablet comprises a cylindrical or rectangular form. Cylindrical or rectangular tablets are usually less high than they are wide, so that the edges or lateral faces are preferably smaller than the opposing main faces. Due these basic underlying shapes of detergent tablet, it is preferable to assign the main faces as the faces that will be covered by the second detergent phase. In this way, it is possible to achieve an essentially complete coverage of the first detergent phase by the second detergent phase, so that handling can be improved.

As described above, at least part of a region of the first detergent phase, not covered by a second detergent phase layer, is given a water-soluble protective coating. Owing to the sandwich construction, such regions of the first detergent phase that are not covered by the second detergent phase are specifically found on the boundary faces of the detergent tablet, i.e. the outer faces that are perpendicular to the tablet layering. The water-soluble protective film preferably comprises a set or hardened liquid coating mass that is stable relative to the first and second detergent phases and which dissolves quite quickly during use, i.e. at the beginning of a cleaning procedure. The additional covering of the sides or boundary faces of the detergent tablet provides protection against accidental contact with the first detergent phase with its caustic, toxic or irritant components during handling of the detergent tablet; but does not delay—or only slightly delays—the dissolution of the first and second detergent phase during use. It is preferred to use water-soluble materials which can be applied in liquid form (as a solution or a liquefied mass) and which then form a water-soluble protective coating. Preferred examples are sucrose compounds, polyethylene glycol and solid or meltable tensides or polymers.

In a further preferred embodiment of the invention, the first detergent phase comprises an alkali system of one or more components chosen from sodium hydroxide (NaOH) or caustic soda, and metasilicate. These components impart a high alkalinity to the first detergent phase and are classified as highly irritant or caustic components that are subject to mandatory labelling. An alkali detergent phase in the context of the invention is a phase that gives a pH value greater than 10, preferably greater than 12, when dissolved in water (in a 1% solution). One such alkali component, or a combination of several such alkali components, possibly also in combination with additional alkali means, can be deployed in the alkaline detergent tablet to set the appropriate alkalinity (also referred to as "basicity"). Setting the pH value is often sufficient to release grease and proteins from soiled surfaces, whereby alkali-based detergents can also exhibit a cleaning effect based on sequestrant groups or surfactant groups as long as these can develop their effectiveness in an alkaline milieu (pH value greater than 10). The alkaline components and an additional detergent component can be combined in one substance, but can equally well be separate substances, as long as they are incorporated in the first detergent phase.

The detergent tablet according to the invention preferably contains alkali detergent components by a fraction of up to 20-80 wt %, particularly preferably 40-70 wt %. In the case of the first detergent phase, in which the strongly alkaline components are concentrated, the amount of alkali detergent components can be up to 100 wt %.

Examples of toxic, caustic or irritant components for the first detergent phase that can be used instead of or in addition to the alkaline components (caustic soda, metasilicate, soda) may be taken from the following compound classes or compounds: sulfamic acid, dicarboxylic acid, maleic acid, fatty acids (in particular short-chained C8 to C10), biocides (e.g. quaternary ammonium compounds). Their proportional amounts lie inside the previously mentioned ranges, or the skilled person will be aware of the concentration to which each substance can be used. For example, the acids can be deployed in concentrations similar to the alkali components in descaling products. The skilled person will also know that biocides are used in lower concentrations of less than 10%, preferably less than 5% to achieve a desired sanitizing effect.

In a further preferred embodiment, the second detergent phase of the inventive detergent tablet comprises a weak alkali system, for example containing soda and/or disilicates, in a composition that is irritant at most (i.e. with a pH value of 10 to 11 in a 1% aqueous solution), preferably with only a pH value in a weakly alkaline range (about 8-10 in a 1% solution). These mildly irritant or non-irritant alkali components are suited for use in the second detergent phase since they can be handled without requiring any significant safety precautions.

The second detergent phase comprises the alkali detergent components preferably to a total amount of not more than about 40 wt %, preferably to a total amount of about 10-30 wt % of the second detergent phase.

Preferably, these alkali components of the first or second detergent phase are added to the tablet blend, and the invention also covers the eventuality that these completely or partially transform into more stable products such as hydrates or oxides in the tablet blend or during the tableting process, as long as the transformation is reversible during use of the detergent tablet in water, so that the desired alkalinity or basicity is achieved. The tablet blend can also be assembled from the alkali components alone. To remove grease and protein from soiled surfaces, it is usually sufficient to set the pH value, whereby alkali-based detergents can also exhibit a cleaning effect based on complexing agent groups or surfactant groups. Protein-denaturing alkali substances can also be used as detergent components as long as they can develop their effectiveness in an alkaline environment.

In a further preferred embodiment of the invention, the first and/or second detergent phase can comprise at least one further detergent substance. Examples of such substances are complexing agents whose additional detergent action is due to the property of chelation. Tensides may also be candidates for such additional detergents. Exemplary compounds may be chosen from the group of ionic or non-ionic tensides or complexing agents, in particular phosphates, polyphosphates, phosphonates, polymers, layer silicates, sodium methyl glycine diacetic acid, poly epoxy succinic acid and gluconates. All of these detergents foam as little as possible, to prevent excessive foaming from the outset. Preferred tensides are fatty alcohol ethoxylates, in particular terminally capped Plurafac® types (BASF), Glucoside (Akzo) or fatty amines. While anionic tensides are conceivable, they are less relevant since they often tend to foam strongly. Alkali-stable phosphonates are for example salts of nitrilo trimethylene phosphonic acid of the Sequion type (Polygon) or Cublen type (Zschimmer & Schwarz). Preferred polymers are polycarboxlyates (BASF).

Complexing agents are preferably deployed in the detergent tablet to a proportion of not more than 10 to 40 wt %, particularly preferably to a proportion of about 15 to 25 wt %. Tensides are preferably deployed in the detergent tablet to an amount of about 0.2 to 20 wt %, particularly preferably to an amount of about 0.5 to 5 wt %. These amounts apply to the entire detergent tablet as well as to the first or second detergent phases.

In a further preferred embodiment, the first and/or second detergent phase can comprise a tablet blend with the usual matrix components. They can also comprise one or more builders (for example water-soluble sulfates such as sodium sulfate) and/or excipients, in particular for example binding agents, tableting excipients, disintegrants, dissolution retardants, retarding agents or lubricants.

The builders are preferably added to the detergent tablet by an amount of not more that 20 wt %, particularly preferably by an amount of not more than 10 wt %. The excipients are preferably added to the detergent tablet by an amount of not more that 20 wt %, particularly preferably by an amount of about 3 to 10 wt %. The amount proportions apply equally to the entire detergent tablet as well as to the first or second detergent phase.

Excipients for tablets fulfill various purposes and are described in the prior art. In principle, distinctions are made between the following categories of the various excipients on the basis of their different functions. Examples of binding agents or direct tableting excipients are starches, celluloses, polyethylene glycol, calcium compounds, bentonite, polysaccharides, sugar compounds, proteins or synthetic polymers.

Examples of disintegrants are starches, (microcrystalline) cellulose, alginic acid, polysaccharides, proteins, cross-connected polyvinyl pyrrolidine, polymethacrylate derivatives or bentonite.

Exemplary dissolution retardants or retarding means can be waxes, ethyl cellulose, lipids, polyvinyl acetate, carboxymethyl cellulose, polyacrylic acid, polyethylene glycol, gels or stearates.

Examples of lubricants are fatty acid esters, talcum, oils and fats or fatty acids, or pyrogenic silicic acid.

Depending on the desired properties of the detergent tablets, for example as regards hardness and solubility as well as to ensure moldability, an appropriate combination of the various excipients and builders is chosen on the basis of the intended field of application.

In addition, further functional compartments or substances such as descaling agents, rinse aids, ion exchangers, a specific detergent for further contaminations etc., can be incorporated in the detergent tablet. This can be achieved for example by using dedicated layers or regions.

An adhesive agent can preferably be deployed to bond together the individual layers of the first and second detergent phase. For example, polyethylene glycol can be used for this purpose. During the manufacturing procedure of the inventive detergent tablet, this is applied in melted form to the opposite faces of the first detergent phase which is then pressed between previously prepared and hardened second detergent phases in order to form a three-layered detergent tablet. Alternatively, the three-layered tablets can be pressed in a carousel-type machine with an integrated form into rectangular or round shapes, with a typical detergent tablet weight between 10 g and 100 g. In this approach, polyethylene glycol (PEG) for example can be added in powder form to the tablet blend.

The inventive detergent tablets can be packaged individually or in groups of a predetermined number in a sealed plastic bag, a so-called flowpack (a tubular bag into which items are inserted horizontally for packaging) so that they can be dispensed as required in a precise and straightforward manner. An individual packaging of each detergent tablet is preferred, but not strictly necessary owing to the improved handling already described in the above, since the strongly alkaline ingredients in the central layer are covered and therefore pose significantly less risk to the user. For this reason, the detergent tablets can be packed in a tightly sealed container, loosely or stacked, without additional secondary packaging such as a tubular bag.

In a further preferred embodiment, the detergent tablet comprises holes and/or recesses that extend through one or more layers of the first and/or second detergent phase. The holes or recesses are in particular in the upper (or also in the lower) surface of the second detergent phase and either extend all the way through the detergent tablet, or at least to the middle layer, i.e. into the first detergent phase, in order to increase the surface area of the exposed first detergent phase. As a result, the rate of dissolution of the first detergent phase layer, i.e. the middle layer, can be increased, even though it has been covered by other detergent layers in order to improve handling. Even though these holes or recesses cannot be touched on the inside on account of their size, their inner surfaces or edges can also be coated with a water-soluble coating if desired.

The method of manufacturing a multiphase detergent tablet, for example for cleaning kitchen appliances particularly in commercial kitchens, comprises amongst others the step of manufacturing an at least three-layered detergent tablet with a first detergent phase with at least one contact-unsuitable, in particular irritant, caustic, toxic or hygroscopic component, and a second detergent phase in the form of a cover of the first detergent phase on at least two opposing sides of the first detergent phase, whereby the second detergent phase essentially does not contain any contact-unsuitable components, specifically not containing caustic, toxic or hygroscopic components, optionally also not containing irritant components. With straightforward process steps and the usual manufacturing facilities, the inventive manufacturing method according to the second aspect of the invention can ensure an improved handling of the detergent tablet.

To further improve the handling or safety during handling, in a further method step a liquid coating can be applied to at least a part of the outer faces or edges of the previously manufactured multiphase detergent tablet that are not covered by the second detergent phase. In this way, a water-soluble and non-hazardous protective coating is formed on these edges or outer faces. Apart from saving material, a coating that is applied exclusively to the outer faces or edges of the detergent tablet has the advantage that the two outer detergent phases are to a large extent free of any coating, and can therefore dissolve quicker than they would if the detergent tablet were completely coated. After manufacturing the multi-phase detergent tablet, for example in a customary carousel tableting facility, the detergent tablets travelling on the conveyor belt can then pass by laterally positioned nozzles or other mechanical arrangements for applying a liquid coating mass.

During the step of applying the coating mass on the detergent tablet, the detergent tablet is advantageously rotated about its own axis continually or intermittently while the coating mass is applied—particularly preferably by spraying, rolling and/or painting—on the edges or sides of the detergent tablet. Alternatively, the coating mass can be applied to the faces by dipping the faces into an immersion bath filled with the liquid coating mass and turning or rolling the detergent tablet. It is hereby advantageous to continually or intermittently convey the tablets to the immersion bath on a conveyor belt arranged slightly above the immersion bath and to dip the detergent tablets into the immersion bath in order to apply the coating mass to the faces.

In the case of rectangular (block) tablets, it is advantageous to rotate these by 90° after applying the coating to one side (or two opposite sides), in order to apply the coating mass to all sides. Preferably in this case, a second, third or fourth arrangement for applying the coating mass is positioned along the conveyor belt. In the case of a cylindrical tablet, it is advantageous to rotate it about its axis of rotation while applying the coating mass, preferably by at least 360°. The coating mass, applied as a liquid or in solution, is then allowed to cool down or harden.

To speed up the cooling or hardening, the manufacturing method advantageously comprises an additional step of cooling the liquid coating mass (liquefied) by a cooling airflow or by evaporation of the solvent using a cold air blower or hot air blower to harden the coating mass.

Subsequently, the finished tablets are packaged, for example in tubular bags. As indicated above, the particular placement of the hazardous components in the multi-phase detergent tablets permits the use of other types of packaging. For example, the detergent tablets are preferably packaged without any tubular bags, loosely or stacked, in a hermetically sealed plastic container for storage or retail.

To improve the solution rate of the middle layer with its high proportion of strongly alkaline, caustic, toxic, irritant or hygroscopic components, it can be helpful to increase the water contact surface for dissolving the middle layer by means of specific solution accelerants or by constructional means.

In a particular embodiment, the surface area of the middle layer can be increased by forming one or more recesses or through-holes in the outer layers of the detergent tablet as described above. To this end, according to a further preferred embodiment of the manufacturing method, an additional step is carried out, i.e. the forming of holes or recesses that extend through one or more layers of the first detergent phase, and the second detergent phase as the case my be. For example, one or more recesses can be formed in the detergent tablet, extending as far inward as possible, by means of a pin (e.g. in a press mold). This ensures that water can penetrate into the tablet from the middle of the tablet also or from several points, dissolving it more quickly.

The inventive detergent tablet can be used to clean kitchen appliances, particularly in the field of commercial kitchens that are usually cleaned with alkaline or strongly alkaline detergents. Examples are industrial dishwashers, ovens, automatic rotisseries, combi-steamers, food warmers, degreasers and strongly soiled surfaces in commercial kitchens, in particular such ovens, automatic rotisseries, combi-steamers, food warmers, and degreasers that have a built-in cleaning program. Of course, this does not exclude the use of the detergent tablets for domestic kitchen appliances or for soiled items, pots, utensils etc. that are cleaned frequently or after each use.

Chloric ingredients in detergent tablets are also classified as toxic or corrosive substances that can be implemented in the first detergent phase. Multiphase detergent tablets of this type can be used for instance as sanitary detergents for lavatories.

Another possible use of the inventive multiphase detergent tablet in automatic dispensing systems follows from the particular layered construction of the three-layered tablet. When the tablets are to be used in an automatic dispenser, in which the tablets cannot be individually wrapped in tubular bags (so-called flowpacks), the exposed tablets lie directly beside or on top of each other. The tablets are stacked in the dispensing arrangement, and usually the lowermost tablet can be dispensed by a mechanical feeder. Since the outer layers do not contain strongly alkaline ingredients, which are usually strongly hygroscopic, humidity will not result in the outer layers sticking to each other. A reliable dispensing of single tablets is therefore ensured. The term "contact-unsuitable" may therefore also be understood to mean that the relevant components of the first detergent phase are not suitable for contact with adjacent tablets because of the undesirable effects that might arise, specifically the agglutination of strongly hygroscopic components of two tablets.

The detergent strength is not affected by the particular construction, since the strongly alkaline ingredients are present in the middle layer, and are released quickly upon dissolution of the detergent tablet. For this reason, it may be preferred that not only the outer two layers of the detergent tablet rapidly dissolve in water, but that the middle layer—with its high proportion of strongly alkaline, caustic, toxic or irritant components—also dissolves quickly. Since the working surface of the water for dissolving the middle layer is relatively small on account of the particular construction of multiphase detergent tablet, it is advantageous to increase the rate of dissolution of the middle layer by means of either specific solution accelerators or design features.

According to a particular embodiment, for the case that the middle layer of the detergent tablet should dissolve quickly enough in water, the surface of the middle layer can be increased as described above by one or more holes, preferably through-holes in the first detergent phase and/or the second detergent phase. To this end, in a straightforward embodiment, one or more recesses, preferably as deep as possible, are formed in the tablet by a fixed pin, preferably with a movable pin. This ensures that water can penetrate into the tablet from the center of the tablet also, or from multiple directions, and the shorter diffusion paths make the tablet dissolve more quickly.

The principle of the invention will be explained in more detail in the following with the aid of the diagrams:

FIG. 1 shows a perspective view of a first embodiment of an inventive detergent tablet, with a rectangular construction.

Figure 1:
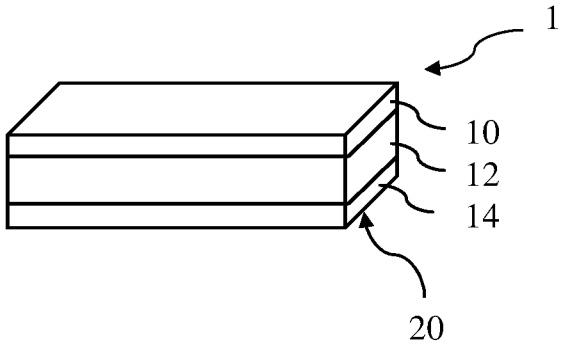
FIG. 1 shows a perspective view of a first embodiment of an inventive rectangular detergent tablet.

The detergent tablet 1 comprises a first layer 10 of a second detergent phase, a second layer 12 of a first detergent phase, and a third detergent layer 14 also of the second detergent phase.

The detergent tablet 1 has a rectangular underlying shape, whereby the two large surfaces of the first detergent phase are covered by the second detergent phase layers. In this way, the first detergent phase with its contact-unsuitable substances, i.e. caustic, toxic, irritant or hygroscopic, is only exposed along the side faces 20, so that the detergent tablet can be safely touched on the second detergent phase faces, in spite of the substances exposed along the side faces.

Figure 2:
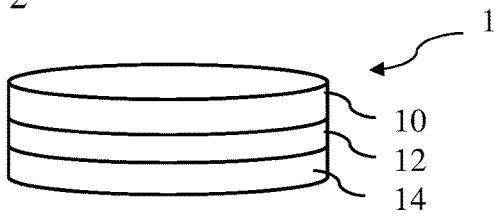
FIG. 2 shows a perspective side view of a second embodiment of an inventive round detergent tablet.

FIG. 2 shows a detergent tablet 1 according to a second embodiment of the invention, constructed analogously to the detergent tablet shown in FIG. 1, but instead with a round underlying form, more precisely a cylindrical underlying form. Apart from the shape, the layered construction is the same as for the detergent tablet shown in FIG. 1.

Figure 3:
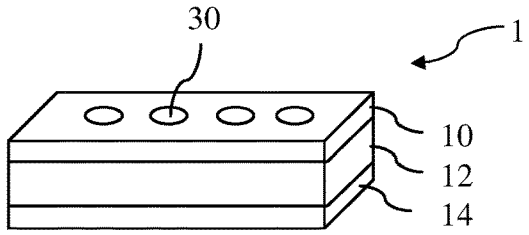
FIG. 3 shows a perspective side view of a third embodiment of an inventive rectangular detergent tablet.

FIG. 3 shows a detergent tablet 1 according to a third embodiment of the invention, constructed analogously to the rectangular detergent tablet shown in FIG. 1, but comprising holes or recesses 30 in the upper surface (and lower surface, as the case may be). The holes either extend all the way through the detergent tablet, or extend at least to the middle layer, i.e. to the first detergent phase, in order to increase the surface area of the exposed first detergent phase and thereby increase the rate of dissolving.

Figure 4:
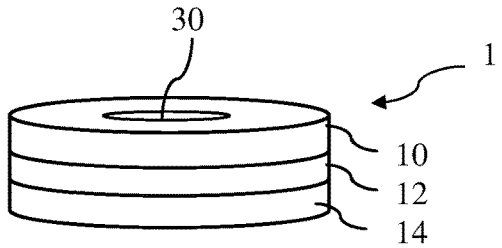
FIG. 4 shows a perspective side view of a fourth embodiment of an inventive round detergent tablet.

FIG. 4 shows a detergent tablet 1 according to a fourth embodiment of the invention, constructed analogously to the detergent tablet shown in FIG. 3, but for which the underlying shape is round, or cylindrical to be exact. Apart from the shape, the layered construction is the same as for the detergent tablet shown in FIG. 3.

Figure 5:
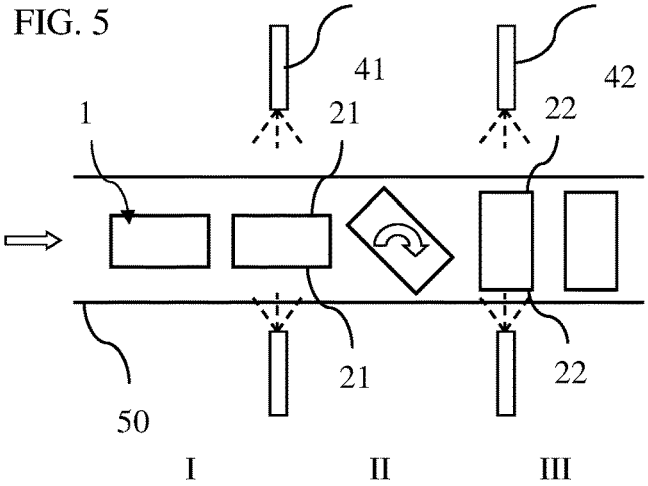
FIG. 5 shows a plan view of an arrangement for applying a coating material to an inventive detergent tablet as shown in FIG. 1.

FIG. 5 shows a plan view of a conveyor belt 50 that is moving detergent tablets 1 in the direction of the arrow. In a first stage I, a coating is applied to the sides 21 by a sprayer 41 on either side of the conveyor belt. In stage II, the detergent tablet 1 is rotated through 90°. The other two sides 22 are then sprayed by the sprayers 42, so that a water-soluble coating is formed on all four sides.

The detergent tablets described in detail above are merely several possible embodiments, and can be modified in the usual manner by the skilled person without departing from the scope of the invention. In particular, there may be specific embodiments of the detergent tablets in other shapes and for other applications than those described herein. Equally, the detergent tablet formulations can be modified by the skilled person in the context of the specific exemplary embodiments described above. It shall be emphasized again that the upper and lower layers of a three-layered multiphase detergent tablet can have different compositions, i.e. the two outer layers of the second detergent phase can be chemically different as long as they contain essentially no contact-unsuitable components or comprise essentially only contact-suitable components. The skilled person will also know how to adjust the individual weight percentages within the scope of the inventive solution to the problem. Use of the indefinite article "a" or "an" does not exclude a plurality of the feature being discussed.

The invention claimed is:

1. A multiphase detergent tablet, comprising:

a first detergent layer with at least one contact-unsuitable component, including caustic, irritant, toxic or hygroscopic components, a second detergent layer to cover a first surface of the first detergent layer, wherein the second detergent layer contains no contact-unsuitable components, including caustic, toxic or hygroscopic components, and a third detergent layer to cover a second surface of the first detergent layer, wherein the third detergent layer contains no contact-unsuitable components, including caustic, toxic or hygroscopic components, wherein an uncovered surface of the first detergent layer that is not covered by the second detergent layer or the third detergent layer is provided with a water-soluble protective film, wherein a surface of the second detergent layer is not provided with the water-soluble protective film, and wherein a surface of the third detergent layer is not provided with the water-soluble protective film.

2. The multiphase detergent tablet according to claim 1, wherein the multiphase detergent tablet comprises a cylinder shape or a block shape.

3. The multiphase detergent tablet according to claim 1, wherein the first detergent layer comprises an alkali system of one or more components selected from sodium hydroxide (caustic soda) and sodium metasilicate.

4. The multiphase detergent tablet according claim 1, wherein the second and/or third detergent layer comprises an alkali system of one or more components selected from soda or di silicates.

5. The multiphase detergent tablet according to claim 1, wherein the first, second and/or third detergent layer comprise an additional detergent, selected from the group of ionic or non-ionic tensides or chelating agents, including phosphates, polyphosphates, phosphonates, polymers, layer silicates, sodium methyl glycine diacetic acid, poly epoxy succinic acid and gluconates.

6. The multiphase detergent tablet according to claim 1, wherein the first, second and/or the third detergent layer also comprise one or more builders and/or excipients, including binding agents, fillers, tableting excipients, disintegrants, dissolution retardants, retarding agents or lubricants.

7. The multiphase detergent tablet according to claim 1, wherein the multiphase detergent tablet comprises holes and/or recesses extending through one or more layers with the first, second and/or third detergent layer.

8. The multiphase detergent tablet according to claim 1, wherein the second and/or third detergent layer includes no irritant components.

9. The multiphase detergent tablet according to claim 1, wherein the first surface of the first detergent layer is a top surface of the first detergent layer, wherein the second surface of the first detergent layer is a bottom surface of the first detergent layer, and wherein the uncovered surface of the first detergent layer is a side surface of the first detergent layer.

10. The multiphase detergent tablet according to claim 9, wherein the surface of the second detergent layer that is not provided with the water-soluble protective film is a top surface of the second detergent layer, and wherein the surface of the third detergent layer that is not provided with the water-soluble protective film is a bottom surface of the third detergent layer.

11. A method of using a multiphase detergent tablet, the multiphase detergent tablet comprising:

a first detergent layer with at least one contact-unsuitable component, including caustic, irritant, toxic or hygroscopic components, a second detergent layer to cover a first surface of the first detergent layer, wherein the second detergent layer contains no contact-unsuitable components, including caustic, toxic or hygroscopic components, and a third detergent layer to cover a second surface of the first detergent layer, wherein the third detergent layer contains no contact-unsuitable components, including caustic, toxic or hygroscopic components, wherein an uncovered surface of the first detergent layer that is not covered by the second detergent layer or the third detergent layer is provided with a water-soluble protective film, wherein a surface of the second detergent layer is not provided with the water-soluble protective film, and wherein a surface of the third detergent layer is not provided with the water-soluble protective film, the method comprising:

cleaning kitchen appliances with the multiphase detergent tablet.

12. A method of manufacturing a multiphase detergent tablet, comprising the step of manufacturing the multiphase detergent tablet, the multiphase detergent tablet comprising:

a first detergent layer with at least one contact-unsuitable component, including caustic, irritant, toxic or hygroscopic components, a second detergent layer to cover a first surface of the first detergent layer, wherein the second detergent layer contains no contact-unsuitable components, including caustic, toxic or hygroscopic components, and a third detergent layer to cover a second surface of the first detergent layer, wherein the third detergent layer contains no contact-unsuitable components, including caustic, toxic or hygroscopic components; and applying a liquid coating mass on an uncovered surface of the first detergent layer that is not covered by the second detergent layer or the third detergent layer, in order to form a water-soluble protective film, wherein a surface of the second detergent layer is not provided with the water-soluble protective film, and wherein a surface of the third detergent layer is not provided with the water-soluble protective film.

13. The method according to claim 12, wherein, during application of the coating mass, the multiphase detergent tablet is continually or intermittently rotated about its own axis while the coating mass is applied on the edges of the multiphase detergent tablet.

14. The method according to claim 12, further comprising a step of cooling the liquid coating mass by means of a cooling airflow, or evaporating the solvent by means of a cooling or warming airflow to solidify the coating mass.

15. The method according to claim 12, further comprising a step of providing holes and/or recesses that extend through one or more layers with the first, second and/or third detergent layer.

16. The method according to claim 12, wherein the first surface of the first detergent layer is a top surface of the first detergent layer, wherein the second surface of the first detergent layer is a bottom surface of the first detergent layer, and wherein the uncovered surface of the first detergent layer is a side surface of the first detergent layer.

17. The method according to claim 16, wherein the surface of the second detergent layer that is not provided with the water-soluble protective film is a top surface of the second detergent layer, and wherein the surface of the third detergent layer that is not provided with the water-soluble protective film is a bottom surface of the third detergent layer.

* * * * *